US010433588B2

(12) United States Patent
Coelho Belo Fernandes De Carvalho

(10) Patent No.: US 10,433,588 B2
(45) Date of Patent: Oct. 8, 2019

(54) PERSONAL VAPORIZER SYSTEM

(71) Applicant: Joyetech Europe Holding GmbH, Zug (CH)

(72) Inventor: Pedro Miguel Coelho Belo Fernandes De Carvalho, Braga (PT)

(73) Assignee: JOYETECH EUROPE HOLDING GMBH, Zug (CH)

( * ) Notice: Subject to any disclaimer, the term of this patent is extended or adjusted under 35 U.S.C. 154(b) by 182 days.

(21) Appl. No.: 15/796,231

(22) Filed: Oct. 27, 2017

(65) Prior Publication Data

US 2018/0049476 A1 Feb. 22, 2018

Related U.S. Application Data

(63) Continuation of application No. 14/259,962, filed on Apr. 23, 2014, now Pat. No. 9,814,264.

(51) Int. Cl.
*A24F 47/00* (2006.01)
*F22B 1/28* (2006.01)

(52) U.S. Cl.
CPC ..... *A24F 47/008* (2013.01); *F22B 1/284* (2013.01)

(58) Field of Classification Search
None
See application file for complete search history.

(56) References Cited

U.S. PATENT DOCUMENTS

2016/0073692 A1* 3/2016 Alarcon ..... A24F 47/008 131/329

* cited by examiner

*Primary Examiner* — Michael J Felton
(74) *Attorney, Agent, or Firm* — Novick, Kim & Lee, PLLC; Allen Xue

(57) ABSTRACT

The present application discloses a personal vaporizer system with an e-liquid reservoir isolated from the atomizer. The isolation of the e-liquid reservoir from the atomizer eliminates particles contamination of the e-liquid held in the reservoir and chemical reactions between the atomizer and the e-liquid. Since the residence time of "fresh" e-liquid in the atomizer is only the necessary to vaporize a very small amount of e-liquid, particles contamination of the produced vapor and chemical reactions between the e-liquid and atomizer components are dramatically reduced. This represents a huge health benefit for the consumer, compared to all others personal vaporizers with an e-liquid reservoir. The disclosed system can be used in any type of personal vaporizer, for example in the electronic cigarette market.

20 Claims, 2 Drawing Sheets

PERSONAL VAPORIZER SYSTEM

TECHNICAL FIELD

The present application discloses a personal vaporizer system.

BACKGROUND

A personal vaporizer system can be used in the electronic cigarette market where it is also called atomizing electronic cigarette.

This type of personal vaporizer system is composed of a power source, usually a battery, which is contained in housing, a liquid storage component and an atomizer. The atomizer is a system composed of a small liquid permeating material and an electric heater. The atomizer requires a delivery e-liquid system to continuously produce vapor. Most of the devices that imitate the cigarette form factor use an e-liquid delivery system. On this application, it is stated that an e-liquid is a liquid solution that is included on a reservoir and is heated by the heating element. Some solutions contain a mixture of nicotine and flavorings, while others release a flavored vapor without nicotine. This delivery system consists of a heating element surrounded by an e-liquid-soaked material that acts as an e-liquid holder or has a deposit, and a wicking material that transport the liquid to the coil to be vaporized. Different wicking systems are employed some rely on gravity to bring the e-liquid to the wick and coil assembly whereas others rely on capillary action, but all allow a permanent connection of the e-liquid storage component with the atomizer or wick and coil assembly.

A standard heating element is composed of a metal alloy wire, containing iron, aluminum and chromium that is wrapped around a silica cable. Usually the heating element is welded to an electrically conductive wire also welded to the main body of the atomizer that will be electrically connected to the power source, the battery. To weld these metals, materials like tin and silver are used.

The document US2011277757 discloses a personal vapor inhaling unit. The document discloses an electronic flameless vapor inhaler unit that may simulate a cigarette that has a cavity which receives a cartridge in the distal end of the inhaler unit. The cartridge brings a substance to be vaporized in contact with a wick. When the unit is activated, and the user provides suction, the substance to be vaporized is drawn out of the cartridge, through the wick, and is atomized by the wick into a cavity containing a heating element. The heating element vaporizes the atomized substance. The vapors then continue to be pulled by the user through a mouthpiece and mouthpiece cover where they may be inhaled.

The document WO2013159245 discloses an electronic cigarette comprising a separate cartridge unit and a vaporizer unit. The cartridge unit may have a cartridge tube containing a liquid with a seal sealing the liquid within the cartridge tube. The vaporizer unit may have a piercer and a heater, with the front side of the vaporizer unit moveable into engagement with the cartridge unit, causing the piercer to pierce the seal in preparation for use of the electronic cigarette. A battery may be connected to a back side of the vaporizer unit. The vaporizer unit may also have an electronic circuit electrically connected to the heater and to an inhalation sensor.

The document US2013220315 discloses an electronic vaporizer. The electronic vaporizer includes a cartridge that facilitates provision of a vaporized solution to an individual.

The cartridge includes a housing that includes an interior, wherein the housing is one of a polymer housing or a ceramic housing. The cartridge also includes a heating element located in the interior of the housing, wherein the heating element is configured to vaporize a solution for oral provision to the individual. The vaporizer may also include a power harvesting device operative to acquire energy from the environment for use with powering the heating element.

Scientific reports already demonstrate the presence of particles and/or nano particles of tin, silver, iron, nickel, aluminum, and silicate in the vapor aerosol. Many of these elements are known to cause respiratory distress and disease. The presence of these particles in the vapor, through the vaporized e-liquid, is directly related with the exposition time of the e-liquid with the atomizer. None of the documents above mentioned provided a solution that can reduce this exposition of the e-liquid with the particles and/or nano particles used on the welding of components.

SUMMARY

In this patent application is described a personal vaporizer system comprising:

- the mouthpiece;
- the body of the vaporizer with a hole that allows the passage of the e-liquid contained in the e-liquid reservoir to the atomizer compartment, caused from the difference of pressure between the inner part of said body of the vaporizer and the e-liquid reservoir, when the consumer causes an intentional suction on the mouthpiece;
- a sleeve that can be made from polymers, ceramics or metals or metal alloy;
- the atomizer;
- the base of the vaporizer comprising an mechanical and electrical connection to a power source;
- a power source;
- a e-liquid reservoir.

In an embodiment, the mouthpiece of the personal vaporizer system is held to the body of the vaporizer by a mechanical joint.

In another embodiment, the mechanical joint of the personal vaporizer system is a mechanical gasket in the shape of a torus.

In even another embodiment, the personal vaporizer system comprises an e-liquid reservoir in the space between the external part of the body of the vaporizer and the internal part of the sleeve.

In an embodiment, the personal vaporizer system comprises a mechanical and electrical connection between the atomizer and the base of the vaporizer.

In another embodiment, the personal vaporizer system comprises a mechanical connection between the body of the vaporizer and the base of the vaporizer.

In even another embodiment, the thinner part of the base of the personal vaporizer system has threads.

In an embodiment, the personal vaporizer system comprises a metallic pin inside the thinner part of the base of the vaporizer.

In another embodiment, the metallic pin of the personal vaporizer system is electrically insulated from the internal part of the base of the vaporizer by an electrically insulating mechanical joint.

In even another embodiment, the mouthpiece of the personal vaporizer system comprises an internal sleeve extension.

In an embodiment, the sleeve of the personal vaporizer system is made from polytetrafluoroethylene and/or polyethylene terephthalate and/or polyacrylonitrile.

In another embodiment, the sleeve of the personal vaporizer system is made from standard glass, borosilicate glass, fused quartz.

In even another embodiment, the sleeve of the personal vaporizer system is made from steel, aluminum, titanium and any other metal or metal alloy for food application.

In an embodiment, the external body of the personal vaporizer system comprises at least one light indicator.

In another embodiment, the electrical resistance in the atomizer of the personal vaporizer system varies between 0.2 and 10 Ohm.

In even another embodiment, the electrical resistance in the atomizer of the personal vaporizer system varies between 0.5 and 5 Ohm.

The present application also discloses the use of the personal vaporizer system as electronic cigarette.

Finally, the present application also discloses the method for operating the personal vaporizer system, which comprises the following steps:

- The e-liquid reservoir is filled with e-liquid through the hole in the top of the inner part of the body of the vaporizer
- the e-liquid is maintained on the e-liquid reservoir;
  - the user injects e-liquid into the top of the atomizer based on the difference of pressure between the internal part of the body of the vaporizer and the e-liquid reservoir, by an intentional suction in the mouthpiece caused by the user;
- a small quantity of e-liquid is injected into the top and inner part of the body of the vaporizer;
- the electrical resistance of the said personal vaporizer system vaporize the e-liquid;
- the user receive the vaporized liquid through the mouthpiece.

General Description

The present application discloses a personal vaporizer system that allows the consumer to have the comfort of a small and safe deposit that hold a sufficient amount of e-liquid for a complete vaporization day, with the warranty that the e-liquid will have the same properties and characteristics as a recently opened e-liquid bottle.

This solution is achieved by isolating the e-liquid in a reservoir produced with high grade steel, which can be coated with food and/or surgical compatible materials, avoiding metal contamination and/or chemical reactions between the e-liquid and more reactive metals from the atomizer. The juice feeding system of the atomizer does not depend on any juice guide material like silica cables, stainless steel meshes, stainless steel cables, ceramic tubes, ceramic rods or cotton wires used in all others systems. This personal vaporizer uses differences of pressure between the atomizer compartment and the e-liquid compartment, caused by an intentional suction of the user, to feed the atomizer with e-liquid. With this system no feedback of e-liquid from the atomizer to the e-liquid compartment is possible, assuring that there is no contamination of the e-liquid held in the deposit.

So, with the technology here described the e-liquid is held in a separated container from the atomizer until the precise moment that the user wants to vaporize. This dramatically reduces the contamination of the e-liquid with the referred particles and eliminates the possibility of chemical reactions between the e-liquid and the metals from the atomizer, bringing a huge health benefit. Furthermore, the recommend expiration date of an opened e-liquid bottle that is, on average 3 months, a much larger period than the required time to vaporize a full deposited with this personal vaporizing system, is maintained, assuring that the liquid is always fresh, i.e. maintain all his characteristics and properties with no degradation or metal particles contamination.

BRIEF DESCRIPTION OF DRAWINGS

Without intent to limit the disclosure herein, this application presents attached drawings of illustrated embodiments for an easier understanding.

1—mouthpiece;
2—body of the vaporizer;
3—sleeve;
4—hole;
5—atomizer;
6—mechanical connection;
7—base of the vaporizer;
8—metallic pin;
9—mechanical joint;
10—internal sleeve extension;
11—compartment;
12—thinner part.

Figure 1:
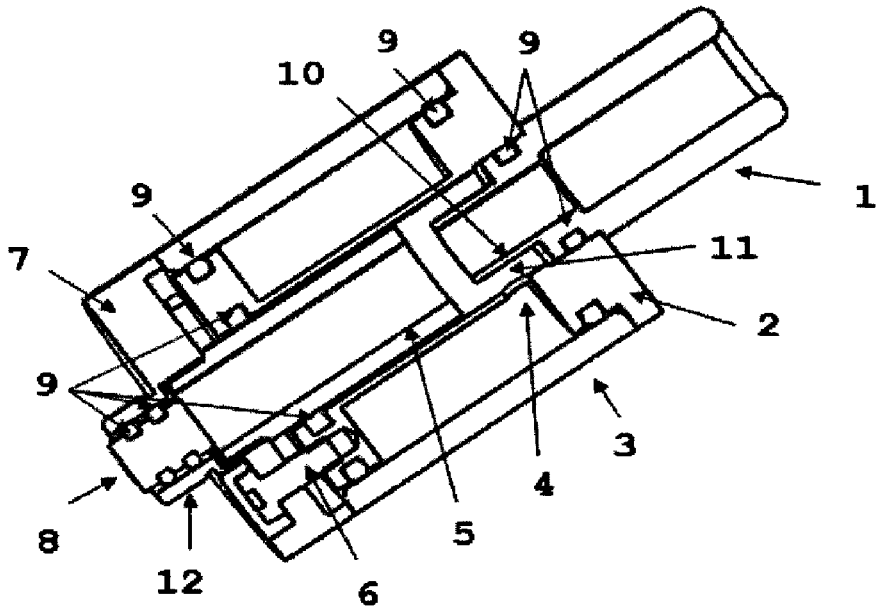
FIG. 1 illustrates an embodiment of the personal vaporizer system where the reference numbers indicate the following elements.
Figure 2:
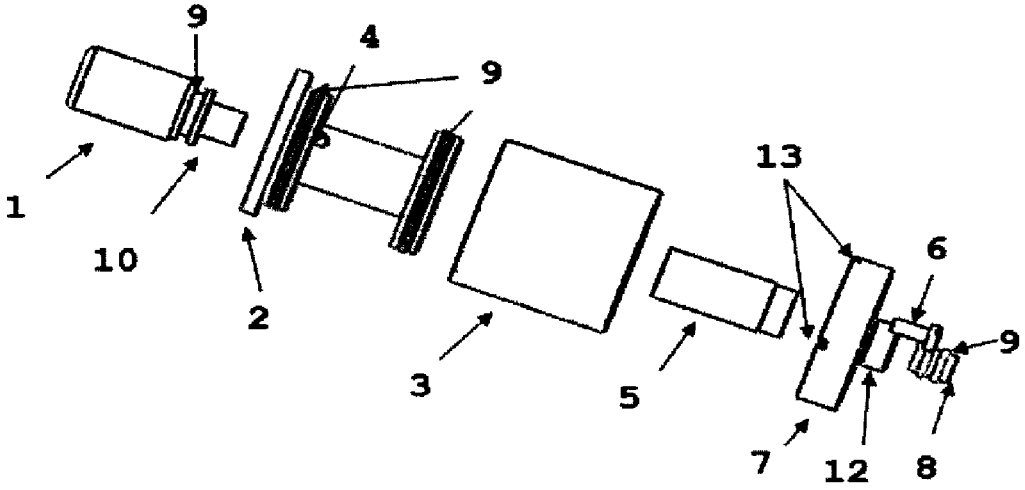

FIG. 2 illustrates an exploded view of an embodiment of the personal vaporizer system where the reference numbers indicate the following elements:

1—mouthpiece;
2—body of the vaporizer;
3—sleeve;
4—hole;
5—atomizer;
6—mechanical connection;
7—base of the vaporizer;
8—metallic pin;
9—mechanical joint;
10—internal sleeve extension;
12—thinner part;
13—air holes

MODE(S) FOR CARRYING OUT EMBODIMENTS

Referring to the drawings, herein are described optional embodiments in more detail, which however are not intended to limit the scope of the present application.

The personal vaporizer system comprises five parts, namely:

- the mouthpiece (1);
- the body of the vaporizer (2) with a hole that cause a difference of pressure between the inner part of said body of the vaporizer and the e-liquid reservoir;
- a sleeve (3) that can be made from polymers such as polytetrafluoroethylene, Polyethylene terephthalate, Polyacrylonitrile or any other polymer for food industry application, ceramics such as standard glass, borosilicate glass, fused quartz and metals, like aluminium, titanium and their alloys and/or metals alloys such as steel.
- the atomizer (5) that can be an industrial atomizer or a handmade one;

the base of the vaporizer (7) that physically and electrically connects the e-liquid reservoir to the power source;

a power source;

a e-liquid reservoir.

The mouthpiece (1) is held to the body of the vaporizer (2) by a mechanical joint (9), which can be for example a mechanical gasket in the shape of a torus, for which it is usually known as a o-ring. The space between the external part of the body of the vaporizer (2) and the internal part of the sleeve (3) forms the e-liquid reservoir. The atomizer (5) has a mechanical connection (6) to the base of the vaporizer (7), for example by a screw or rivet. The body of the vaporizer (2) has also a mechanical connection (6) to the base of the vaporizer (7), for example by a screw or rivet. The thinner part (12) of the base of the vaporizer (7) can have threads that allow the connection of the personal vaporizer system in a power source system, like a battery holster or other. Inside the thinner part (12) of the base of the vaporizer (7) is a metallic pin (8), electrically insulated from the internal part of the base of the vaporizer (7) by a mechanical joint (9). The external part of the thinner part (12) of the base of the vaporizer (7) and the metallic pin (8) make the electrical connection to the power source.

This power source ensure that the personal vaporizer system is provided with the enough amount of energy to heat the electrical resistance, which typically varies from 0.2 to 10 Ohm but in some preferred embodiments can vary between 0.5 and 5 Ohm, that will burn the e-liquid. This power source can be a battery or an alkaline battery. In the case of using a battery, this battery can be charged through a connection with a wall socket, a port on a computer like a USE port and/or by the use of a solar cell.

The external body of the personal vaporizer system can further comprise at least one light indicator, for example a LED lamp, which can be, for example, activated each time the user puffs through the mouthpiece (1).

The procedure for injecting fresh e-liquid into the top of the atomizer is based on the difference of pressure between the internal part of the body of the vaporizer (2) and the e-liquid reservoir, created by the user when he intentionally puffs through the mouthpiece (1), creating suction. Using the difference of pressure to move the e-liquid from the e-liquid reservoir to the atomizer (5), without using any juice guide material like: silica cables, stainless steel meshes, stainless steel cables, ceramic tubes, ceramic rods or cotton wires used in all others systems, guarantees no particles contamination or chemical reactions between the materials from the atomizer (5) and the e-liquid contained in the e-liquid reservoir.

In the body of the vaporizer (2) there is a hole (4), putting the personal vaporizer in a position that when the e-liquid cover the hole, slightly upside-down, and the user makes a puff in the mouthpiece (1), this cause a difference of pressure between the inner part of body of the vaporizer (2) that contains the atomizer (5) and the e-liquid reservoir, that injects a small quantity of e-liquid into the top and inner part (11) of the body of the vaporizer (2). The design of the mouthpiece (1), with an internal sleeve extension (10), avoids that the e-liquid goes directly to the mouth of the user, holding it in the compartment (11), formed by the external part of the extension sleeve (10) of the mouthpiece and the internal part of the body of the vaporizer (2). When the user puts the personal vaporizer in the standard position used to vaporize the e-liquid will fall directly into the top of the atomizer. After vaporizing this small amount of e-liquid the user can repeat the process having always fresh e-liquid to vaporize.

Naturally, the present embodiments are not in anyway limited to the embodiments described in this document and a person with average knowledge in the field will be able to predict many possible changes to it without deviating from the main idea, as described in the claims.

The invention claimed is:

1. A personal vaporizer system, comprising:

a body of the vaporizer defining a hole, a mouthpiece mounted on the body of the vaporizer and having an internal sleeve extension, an e-liquid reservoir for holding an e-liquid, a compartment, and an atomizer, wherein the mouthpiece and the hole are isolated from each other by the internal sleeve extension, the hole allows the e-liquid stored in the e-liquid reservoir to flow into the compartment, and the atomizer is configured to heat the e-liquid from the compartment.

2. The personal vaporizer system of claim 1, wherein a suction on the mouthpiece causes a difference of pressure between an inner part of the body of the vaporizer and the e-liquid reservoir, and the difference of pressure causes the e-liquid stored in the e-liquid reservoir flow into the compartment.

3. The personal vaporizer system of claim 2, wherein the atomizer is located in the inner part of the body of the vaporizer.

4. The personal vaporizer system of claim 2, wherein the compartment is foil led by an external part of the internal sleeve extension and the inner part of the body of the vaporizer.

5. The personal vaporizer system of claim 1, further comprising a sleeve disposed outside the body of the vaporizer, wherein a space between an external part of the body of the vaporizer and an internal part of the sleeve forms the e-liquid reservoir.

6. The personal vaporizer system of claim 1, further comprising a base, wherein the atomizer has a mechanical and electrical connection to the base, and the base has a mechanical and electrical connection to a power source.

7. The personal vaporizer system of claim 6, wherein the base includes a thinner part, and the thinner part has threads that allows the mechanical connection between the base and the power source.

8. The personal vaporizer system of claim 7, wherein a metallic pin is mounted inside the thinner part, and the metallic pin is electrically insulated from an internal part of the base by an electrically insulating mechanical joint.

9. A personal vaporizer system, comprising:

a body of the vaporizer defining a hole, a mouthpiece mounted on the body of the vaporizer, an e-liquid reservoir for holding an e-liquid, a compartment, and an atomizer, wherein a suction on the mouthpiece causes a difference of pressure between an inner part of the body of the vaporizer and the e-liquid reservoir, the difference of pressure causes the e-liquid stored in the e-liquid reservoir flow into the compartment when the vaporizer in a first position, and the e-liquid in the compartment falls into the atomizer when the vaporizer in a second position.

10. The personal vaporizer system of claim 9, wherein the mouthpiece includes an internal sleeve extension, the compartment is formed by an external part of the internal sleeve extension and the inner part of the body of the vaporizer.

11. The personal vaporizer system of claim 9, wherein the atomizer is located in the inner part of the body of the vaporizer.

12. The personal vaporizer system of claim 9, further comprising a sleeve disposed outside the body of the vaporizer, wherein a space between an external part of the body of the vaporizer and an internal part of the sleeve forms the e-liquid reservoir.

13. The personal vaporizer system of claim 9, further comprising a base, wherein the atomizer has a mechanical and electrical connection to the base, and the base has a mechanical and electrical connection to a power source.

14. The personal vaporizer system of claim 13, wherein the base includes a thinner part, and the thinner part has threads that allows the mechanical connection between the base and the power source.

15. The personal vaporizer system of claim 14, wherein a metallic pin is mounted inside the thinner part, and the metallic pin is electrically insulated from an internal part of the base by an electrically insulating mechanical joint.

16. The personal vaporizer system of claim 13, wherein the body of the vaporizer has a mechanical connection to the base.

17. The personal vaporizer system of claim 12, wherein the sleeve is made of one of a group of polymers, ceramics and metals.

18. The personal vaporizer system of claim 17, wherein the polymers is at least one of a group of polytetrafluoroethylene, polyethylene terephthalate and polyacrylonitrile.

19. The personal vaporizer system of claim 17, wherein the ceramics is at least one of a group of standard glass, borosilicate glass and fused quartz.

20. The personal vaporizer system of claim 17, wherein the metals is at least one of a group of steel, aluminum and titanium.

* * * * *